US005334053A

United States Patent [19]

Noschese

[11] Patent Number: 5,334,053

[45] Date of Patent: Aug. 2, 1994

[54] DUAL-BEAM ELECTRICAL CONTACT WITH PRELOAD TABS

[75] Inventor: Rocco J. Noschese, Wilton, Conn.

[73] Assignee: Burndy Corporation, Norwalk, Conn.

[21] Appl. No.: 963,421

[22] Filed: Oct. 19, 1992

[51] Int. Cl.[5] ..... H01R 23/02

[52] U.S. Cl. ..... 439/682; 439/857

[58] Field of Search ..... 439/660, 682, 856, 857, 439/851, 861, 862, 636

[56] References Cited

U.S. PATENT DOCUMENTS

| | | | |
|---|---|---|---|
| 2,289,172 | 7/1942 | Beal | 439/857 |
| 2,539,230 | 1/1951 | Craig | 439/857 |
| 3,047,831 | 7/1962 | Majewski | 439/636 |
| 3,601,775 | 8/1971 | Longenecker | 439/636 |
| 3,818,423 | 6/1974 | McDonough | 339/258 P |
| 3,865,462 | 2/1975 | Cobaugh et al. | 339/176 M |
| 4,140,361 | 2/1979 | Sochor | 339/258 P |
| 4,327,956 | 5/1982 | Sitzler | 339/107 |
| 4,480,386 | 11/1984 | Adams | 29/874 |
| 4,606,599 | 8/1986 | Grant et al. | 439/682 |
| 4,607,907 | 8/1986 | Bogursky | 339/258 P |
| 4,752,246 | 6/1988 | Triner et al. | 439/682 |
| 4,973,273 | 11/1990 | DePriest | 439/856 |

FOREIGN PATENT DOCUMENTS

| | | | |
|---|---|---|---|
| 2453992 | 5/1975 | Fed. Rep. of Germany | 439/660 |

*Primary Examiner*—Larry I. Schwartz
*Assistant Examiner*—Hien D. Vu
*Attorney, Agent, or Firm*—Perman & Green

[57] ABSTRACT

An electrical connector is provided with a housing and a plurality of electrical contacts. The housing has a plurality of contact receiving channels having preload shelves. The contacts each have two opposing cantilever arms and means for biasing a distal end of one of the arms towards the other arm. The distal ends of the arms have preload tabs that contact each other during insertion of the contact into the housing, and are used to preload the arms at their final position in the housing.

13 Claims, 2 Drawing Sheets

DUAL-BEAM ELECTRICAL CONTACT WITH PRELOAD TABS

BACKGROUND OF THE INVENTION

1. Field Of the Invention

The present invention relates to electrical connectors and, more particularly, to an electrical connector having improved dual-beam contacts with preload tabs.

2. Prior Art

U.S. Pat. No. 4,973,273 to DePriest discloses a dual-beam contact and a housing having a ramp for preloading contact beams of the contact. U.S. Pat. No. 4,327,956 to Sitzler discloses a contact with opposed stand-off tabs. Other relevant art includes U.S. Pat. Nos. 4,140,361; 4,607,907; 3,865,462; 4,752,246; 3,818,423; and 4,480,386.

SUMMARY OF THE INVENTION

In accordance with one embodiment of the present invention an electrical connector contact is provided comprising a rear section, a middle section, and two arms extending from the middle section. The middle section is integrally formed with the rear section. The two arms include opposing spaced preload tabs at their distal ends, opposing space contact areas, and means for moving the opposing preload tabs into contact with each other comprising an extended portion on one of the arms adapted to contact an interior wall in a channel of a housing of an electrical connector, the extended portion being deflectable towards the opposite arm to thereby move the preload tabs into contact with each other during insertion into the housing channel in order to keep the contact areas spaced from each other.

In accordance with another embodiment of the present invention an electrical connector is provided comprising a housing and electrical contacts located, at least partially, in receiving channels of the housing. The housing is comprised of an electrically insulating material. The contacts have a rear section, a middle section, and two opposing cantilever first and second arms extending from the middle section, and means for biasing a distal end of the first arm towards the second arm when the contact is inserted into one of the channels, the means for biasing comprising the first arm having an extended portion, the width of the contact between the extended portion and the second arm prior to location in the housing being greater than the width of the channel such that the contact is compressed by the housing to move the two arms against each other.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
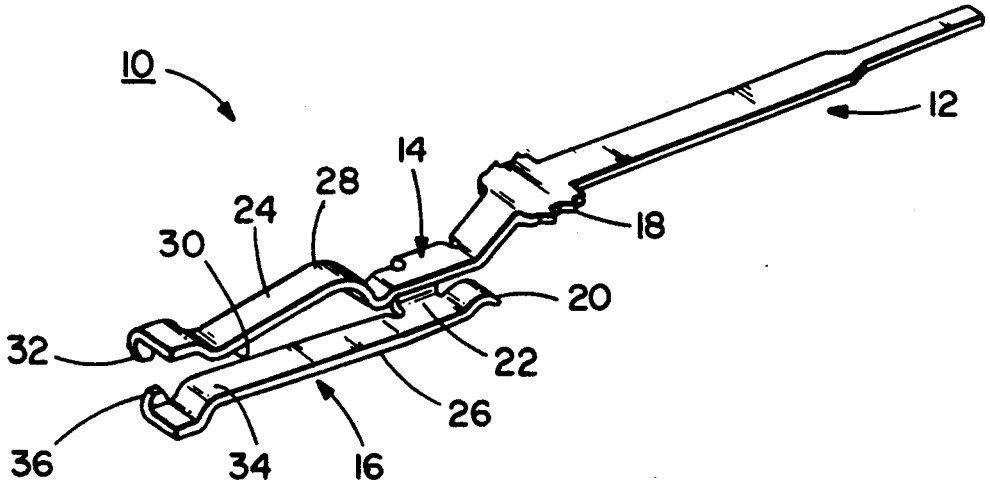
FIG. 1 is a perspective view of an electrical connector contact incorporating features of the present invention.

Referring to FIG. 1, there is shown a perspective view of an electrical connector contact incorporating features of the present invention. Although the present invention will be described with reference to the embodiments shown in the drawings, it should be understood that the present invention may be incorporated into various different types of alternate embodiments. In addition, any suitable size, shape or type of members or materials could be used.

The contact 10 is a one-piece member generally comprised of a sheet of electrically conductive metal that is cut and deformed, such as by stamping, to form the contact shown. FIG. 3 shows a blank contact after it has been cut, but prior to being deformed. The contact 10 generally comprises a rear section 12, a middle section 14, and a front section 16. The rear section 12 is a solder tail adapted to be inserted into a hole in a printed circuit board (not shown) and soldered to a contact area at the hole. However, any suitable type of rear section could be provided. The middle section 14, in the embodiment shown, includes retention areas 18, 20 and a cross-sectional C-shaped area 22. The front section 16 generally comprises two arms 24, 26 that extend from the middle section 14 in general cantilever fashion. The first upper arm 24 includes a curved extended portion 28 located proximate the middle section 14, a contact area 30, and a preload tab 32 at its distal end. The upper arm 24 cants from the extended portion 28 towards the center axis of the contact 10 along the length of the arm 24 until it reaches the contact area 30. The lower second arm 26 has a slight bend proximate the middle section 14 to cant the arm 26 towards the center axis of the contact, a contact area 34, and a preload tab 36 at its distal end. The two tabs 32, 36 are located on the same side of the contact 10 and face each other in a spaced opposing configuration. The two contact areas 30 and 34 are also in a general spaced opposing configuration and are adapted to receive a male contact or pin 38 of a second electrical connector 40 therebetween to make electrical contact with the pin 38 (see FIG. 2). One of the advantages of the present invention is that, even though the contact areas 30, 34 oppose each other, because they are spaced, the areas 30, 34 can be plated, such as with tin, silver, gold, etc., after they have been formed. This can reduce plating costs and insure good final plated contact areas 30, 34 that might not otherwise occur if plated before being formed. As can be seen in FIG. 3, the undeformed length of the upper arm 24 is longer than the undeformed length of the lower arm 26. however, after the contact is shaped as shown in FIG. 1, the arms 24 and 26 extend substantially the same distance from the middle section 14.

Figure 2:
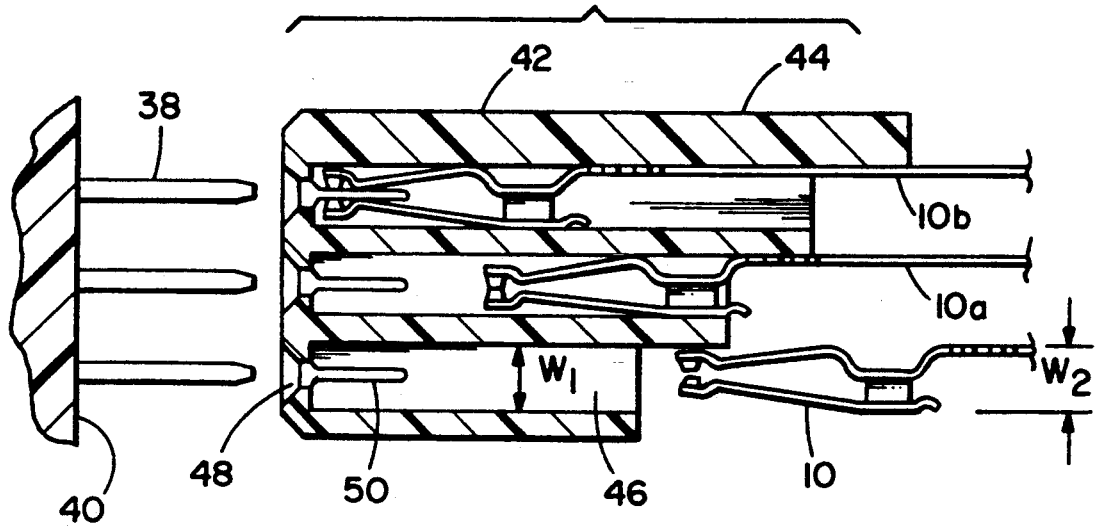
FIG. 2 is a schematic cross sectional view of an electrical connector having contacts as shown in FIG. 1 inserted therein.
Figure 3:
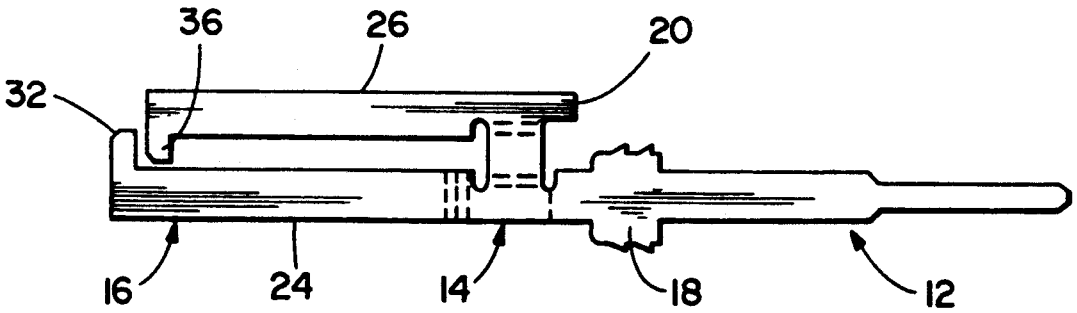
FIG. 3 is a plan top view of an electrical contact blank that is used to form the contact shown in FIG. 1.

Referring also to FIG. 2, a schematic cross-section view of an electrical connector 42 incorporating the contacts 10 is shown. The connector 42 is a female connector generally adapted to be connected to the male connector 40. The female connector 42 has a housing 44 made of dielectric material, such as molded plastic or a polymer material. In the embodiment shown, the housing 44 has three rows of contact receiving channels 46 with a width $W_1$. The contacts 10 are inserted through open rear ends of the channels 46. Located at the front of the channels 46 are apertures 48 for the pins 38 of the male connector 40 to project through. Also located at the front of the channels 46 are preload shelves 50 that extend along the sides of the channels 46, but do not extend in front of the apertures 48. Therefore, the preload shelves 50 do not block access of the pins 38 through the apertures 48 and into the channels 46. This type of housing is generally known in the art.

With particular reference to FIGS. 1 and 2, mounting of the contacts 10 in the housing 44 will now be described. The contacts 10, in their free state as shown in FIG. 1, generally have a width $W_2$. The width $W_2$ is slightly larger than the channel width $W_1$. Therefore, when the contacts 10 are inserted into the channels 46, the contacts 10 are compressed by the walls of the channels 46. This compression generally takes place between the two widest areas of the contacts 10; namely, between the extended portion 28 and the middle section 14 proximate the lower arm 26. Contact **10*b* illustrates a fully inserted contact and Contact 10*a* illustrates a partially inserted contact. As seen with reference to contact 10*a*, when initially inserted into a channel 46, prior to the contact 10*a* reaching the preload shelf 50, the contact 10*a* is compressed such that the upper arm 24 is pushed towards the lower arm 26. The two preload tabs 32 and 36 contact each other thereby keeping the contact areas 30 and 34 spaced from each other. This prevents the plating on the contact area 32 and 36 from being damaged and, provides easier mounting of the contact onto its preload shelf 50. As seen with reference to contact 10*b* and comparison with contact 10*a*, when fully inserted the preload tabs contact opposite sides of the preload shelf and are therefore spaced from each other by the preload shelf 50. The contact areas 30 and 34 are thus precisely positioned relative to the aperture 48 to insure that the male contact 38 will be properly received between the contact areas 30 and 34. The front edges of the preload tabs 32 and 36 are preferably beveled to assist in loading the tabs onto the shelf 50. The compression of the contacts 10 by the walls of the housing 44 and the deflection of the distal forward ends of the arms 24, 26 by the preload shelves 50 combine to preload the contacts 10 to exert an initial and relatively higher contact load on the male contacts 38**. This insures a good electrical contact between the two contacts.

Figure 4:
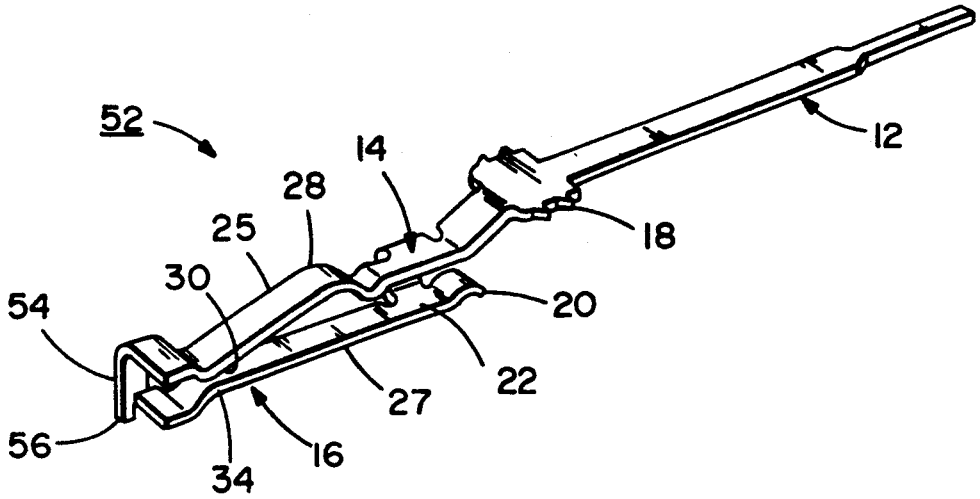
FIG. 4 is an alternate embodiment of an electrical contact incorporating features of the present invention.
Figure 5:
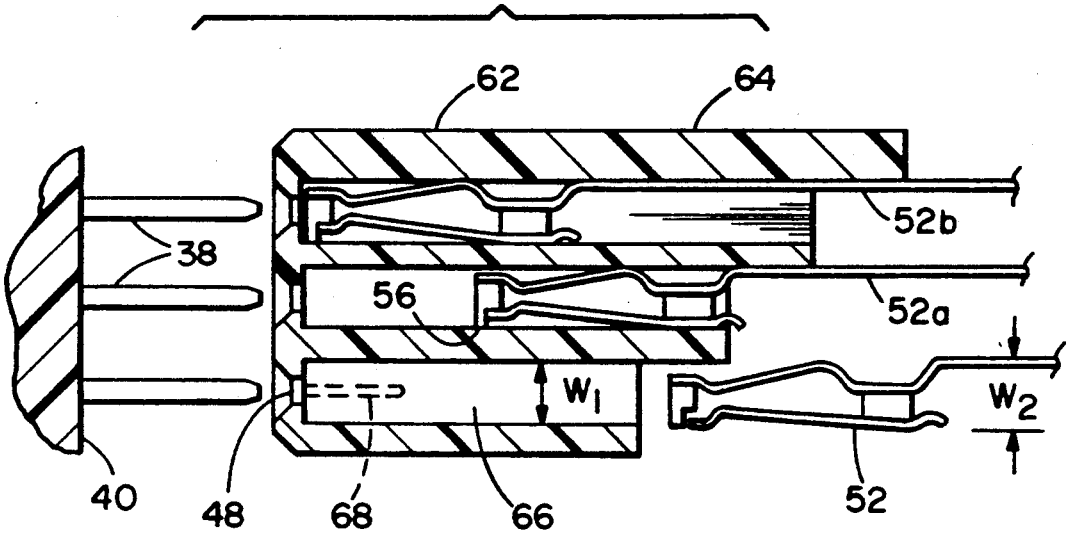
FIG. 5 is a schematic cross sectional view of an electrical connector having contacts as shown in FIG. 4 inserted therein.
Figure 6:
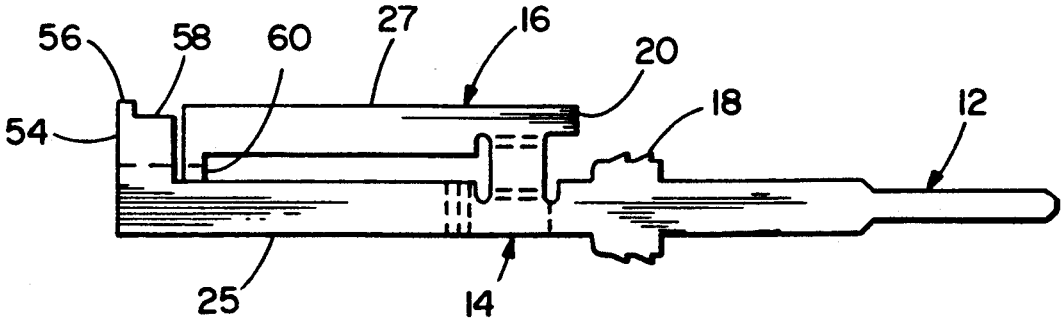
FIG. 6 is a plan top view of an electrical contact blank used to form the contact shown in FIG. 4.

Referring now to FIGS. 4–6, an alternate embodiment of the present invention is shown. The contact 52 is similar to the contact 10. Therefore, the same numbers are used to identify similar features. The contact 52 is a one-piece member generally comprised of a sheet of electrically conductive metal that is cut and deformed, such as by stamping, to form the contact shown. FIG. 6 shows a blank contact after it has been cut, but prior to being deformed. The contact 52 generally comprises a rear section 12, a middle section 14, and a front section 16. The rear section 12 is a solder tail adapted to be inserted into a hole in a printed circuit board (not shown) and soldered to a contact area at the hole. The middle section 14, in the embodiment shown, includes retention areas 18, 20 and a cross-sectional C-shaped area 22. The front section 16 generally comprises two arms 25, 27 that extend from the middle section 14 in general cantilever fashion. The first upper arm 25 includes a curved extended portion 28 located proximate the middle section 14, a contact area 30, and a preload tab 54 at its distal end. The upper arm 25 cants from the extended portion 28 towards the center axis of the contact 10 along the length of the arm 25 until it reaches the contact area 30.

The lower second arm 27 has a slight bend proximate the middle section 14 to cant the arm 27 towards the center axis of the contact and a contact area 34. The two contact areas 30 and 34 are also in a spaced opposing configuration and are adapted to receive a male contact 38 of the second electrical connector 40 therebetween to make electrical contact with the pin 38 (see FIG. 5). As can be seen in FIG. 6, the undeformed length of the upper are 25 is longer than the undeformed length of the lower arm 27. However, after the contact is shaped as shown in FIG. 4, the arms 25, 27 extend substantially the same distance from the middle section 14, the end of the upper arm 25 being slightly longer.

In the embodiment shown, the preload tab 54 is bent substantially perpendicular to the rest of the arm 25 and includes a locator tab 56 and a notch 58. The distal end of the lower arm 27 has a preload tab or shelf 60 that extends at a lateral right angle to the center axis of the arm 27. The shelf 60 is located under the notch 58 and the locator tab 56 extends in front of and past the front of the lower arm 27.

Referring also to FIG. 5, a schematic cross-sectional view of an electrical connector 62 incorporating the contacts 52 is shown. The connector 62 is a female connector generally adapted to be connected to the male connector 40. The female connector 62 has a housing 64 made of dielectric material, such as molded plastic or a polymer material. In the embodiment shown, the housing 64 has three rows of contact receiving channels 66 with a width $W_1$. The contacts 52 are inserted through open rear ends of the channels 66. Located at the front of the channels 66 are apertures 48 for the pins 38 of the male connector 40 to project through. However, unlike the housing 44 shown in FIG. 2, the housing 64 does not have a preload shelf; its absence illustrated by phantom lines 68 in FIG. 5. The housing 64 may be molded without the preload shelf or, may be molded with a shelf which is later removed.

In the embodiment shown, the contact 54 is able to both preload the arms 25, 27 in the channel 66 and position or locate its front end in a central location relative to the pin aperture 48. The contacts 52, in their free state as shown in FIG. 4, generally have a width $W_2$. The width $W_2$ is slightly larger than the channel width $W_1$. Therefore, when the contacts 52 are inserted into the channels 66, the contacts 52 are compressed by the walls of the channels 66. This compression generally takes place between the two widest areas of the contacts 52; namely, between the extended portion 28 and the middle section 14 proximate the lower arm 27. Contact **52*b* illustrates a fully inserted contact and contact 52*a* illustrates a partially inserted contact. As seen with reference to contact 52*a*, when initially inserted into a channel 66, the contact 52*a* is compressed such that the upper arm 25 is pushed towards the lower arm 27. The preload tab 54 contacts the shelf 60 thereby keeping the contact areas 30 and 34 spaced from each other. The tip of the locator tab 56 also contacts the opposite wall of the channel 66 and thereby stops further deflection of the upper arm 25. Thus, the arms 25, 27 are preloaded against each other and, the locator tab 56 positions the contact areas 30 and 34 directly behind the aperture 48**.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector contact comprising:

a rear section;

a middle section integrally formed with the rear section; and two opposing arms extending from the middle section, the two arms including opposing spaced preload tabs at their distal ends, opposing spaced contact areas, and means for moving the opposing preload tabs into contact with each other comprising an extended portion on one of the arms adapted to contact an interior wall in a channel of a housing of an electrical connector, the extended portion being deflectable towards the other one of the arms to thereby move the preload tabs into contact with each other during insertion into the housing channel in order to keep the contact areas spaced from each other.

2. A contact as in claim 1 wherein the middle section has a general C-shaped cross-sectional shape.

3. A contact as in claim 1 wherein the middle section comprises means for retaining the contact in the housing channel.

4. A contact as in claim 1 wherein the extended portion is located proximate the middle section.

5. A contact as in claim 1 wherein the preload tabs have inclined front surfaces to assist in loading the preload tabs onto a preload shelf of the housing in the housing channel.

6. A contact as in claim 1 wherein the contact is comprised of a sheet of metal that is cut and deformed to form a one-piece member.

7. A contact as in claim 1 wherein one of the arms has a locator tab at its distal end.

8. An electrical connector comprising:

a housing comprised of an electrically insulating material, the housing having contact receiving channels; and electrical contacts located, at least partially, in the receiving channels, the contacts each having a rear section, a middle section, two opposing cantilever first and second arms extending from the middle section, and means for biasing a distal end of the first arm towards a distal end of the second arm when the contact is inserted into one of the channels, the means for biasing comprising the first arm having an extended portion, the width of the contact between the extended portion and the second arm prior to location in the housing being greater than the width of the channel such that the contact is compressed by the housing to move the two arms against each other wherein the distal ends of the arms each comprise a tab that contact each other when the electrical contact is inserted into the receiving channel in order to keep contact areas on the arms spaced from each other.

9. An electrical connector as in claim 8 wherein the housing includes preload shelves located in the receiving channels contacted by the two arms.

10. An electrical connector as in claim 8 wherein the middle section has a general C-shaped cross-section.

11. An electrical connector as in claim 8 wherein the arms each have directly opposing spaced contact areas.

12. An electrical connector as in claim 8 wherein the first arm has a locator tab at its distal end for locating the distal ends of the arms at a predetermined position in the receiving channels.

13. An electrical connector as in claim 8 wherein the extended portion is located proximate the middle section.

* * * * *